US010172509B1

(12) United States Patent
Ketron

(10) Patent No.: US 10,172,509 B1
(45) Date of Patent: Jan. 8, 2019

(54) ATHLETIC SHOE CLEANING AND STORAGE UNIT

(71) Applicant: Freddie Wayne Ketron, Abingdon, VA (US)

(72) Inventor: Freddie Wayne Ketron, Abingdon, VA (US)

( * ) Notice: Subject to any disclaimer, the term of this patent is extended or adjusted under 35 U.S.C. 154(b) by 339 days.

(21) Appl. No.: 14/999,508

(22) Filed: May 17, 2016

Related U.S. Application Data

(63) Continuation-in-part of application No. 14/120,050, filed on Apr. 17, 2014, now abandoned.

(60) Provisional application No. 61/854,148, filed on Apr. 18, 2013.

(51) Int. Cl.

| | |
|---|---|
| ***A47L 23/22*** | (2006.01) |
| ***A47L 23/24*** | (2006.01) |
| ***A47L 23/28*** | (2006.01) |
| ***B65D 85/18*** | (2006.01) |
| ***B65D 43/02*** | (2006.01) |
| ***B65D 45/00*** | (2006.01) |
| ***B65D 51/16*** | (2006.01) |
| ***B65D 25/28*** | (2006.01) |
| ***A47L 23/26*** | (2006.01) |

(52) U.S. Cl.
CPC ..... *A47L 23/28* (2013.01); *A47L 23/22* (2013.01); *A47L 23/24* (2013.01); *A47L 23/266* (2013.01); *B65D 25/28* (2013.01); *B65D 43/02* (2013.01); *B65D 45/00* (2013.01); *B65D 51/16* (2013.01); *B65D 85/187* (2013.01); *B65D 2525/283* (2013.01)

(58) Field of Classification Search
CPC ..... A47L 23/22; A47L 23/24; A47L 23/28
See application file for complete search history.

(56) References Cited

U.S. PATENT DOCUMENTS

| | | | | | |
|---|---|---|---|---|---|
| 162,510 | A * | 4/1875 | Wessar | A47L 23/24 | 15/215 |
| 387,678 | A * | 8/1888 | Fischer | A47L 23/26 | 15/216 |
| 2,526,485 | A * | 10/1950 | Kortick | A47L 13/502 | 15/142 |
| 2,977,620 | A * | 4/1961 | Nilsson | A47L 11/4036 | 15/142 |
| 3,283,756 | A * | 11/1966 | Turley | A61H 35/006 | 15/104.92 |
| 3,939,825 | A * | 2/1976 | Krummenacher | A47K 7/04 | 601/104 |
| 4,494,267 | A * | 1/1985 | Fredley | A46B 17/06 | 15/1 |
| 4,872,235 | A * | 10/1989 | Nielsen | A45D 24/44 | 15/104.92 |
| 5,071,628 | A * | 12/1991 | Alazet | A47L 23/266 | 15/215 |

(Continued)

*Primary Examiner* — Randall Chin

(57) ABSTRACT

A shoe or cleat cleaning and transport unit structured as a box providing a storage cavity, in which a cleaning tray is removably positioned and resting on support structure whereby the tray is elevated above the box floor to provide a debris collection receptacle space between the floor and the tray, wherein the tray is formed with multiple upstanding brush or other mud scraping structure bordered by debris exit ports extending through the tray and opening into the debris collection space between the tray and the box floor.

10 Claims, 4 Drawing Sheets

(56) References Cited

U.S. PATENT DOCUMENTS

| | | | | |
|---|---|---|---|---|
| D406,680 | S * | 3/1999 | Hakker | D32/35 |
| 2002/0152566 | A1 * | 10/2002 | Nappi, Sr. | A47L 23/02 15/36 |

* cited by examiner

ATHLETIC SHOE CLEANING AND STORAGE UNIT

This application is a Continuation-in-Part of application Ser. No. 14/120,050 filed Apr. 17, 2014, now abandoned, of same title and claims the benefit of said application and of Applicant's Provisional 61/854,148 filed Apr. 18, 2013 and titled "Athletic Shoe Storage Unit".

BACKGROUND

Field

This invention is directed to a container for cleaning and temporarily storing athletic shoes such as baseball or soccer cleats which typically can be dripping wet and heavily caked with mud. As often happens parents are faced with the prospect of finding a way to get their children into a clean auto with muddy shoes (perhaps two or more pairs) in their hands. The present container provides a means for cleaning and storing the muddy shoes either in an auto or inside or outside of a home wherein the container has structure which allows it to be easily cleaned and wherein the container structure design features can readily be enlarged for carrying multiple shoe pairs.

Prior Art

Many cleat (shoe) or cleaning and/or storage means have been proposed as shown in U.S. Pat. Nos. 3,100,312; 5,509,170; 6,032,316; 6,898,817; 6,912,752; and 8,161,590; the disclosures or which are hereby incorporated herein by reference it their entireties. However, their physical appearances, convenience of use, versatility, structural complexity, manufacturing cost, and their efficiency and effectiveness of use cannot match the presently claimed invention.

In preferred embodiments the present invention is summarized as a shoe or cleat container structure comprising a box like body having a floor and peripheral upstanding side and end sections forming a vertically opening storage cavity, a substantially planar cleaning tray removably positioned within the cavity and resting on substantially horizontal ledge means on the container whereby the tray is elevated above the floor to provide a debris collection receptacle space between the floor and the tray, wherein the tray is provided with a plurality of upstanding scraping projections interspersed with debris exit ports extending through the tray and opening into the receptacle space for transferring mud, grass or the like from the shoe into the receptacle space as the shoe cleats are rubbed against the scraping projections.

DESCRIPTION OF THE DRAWINGS

The invention will be understood further from the drawings herein of the present container structure wherein the figures are largely self explanatory and are numbered 1 thru 13 and wherein some typical dimensions are shown in inches and wherein.

Figure 2:
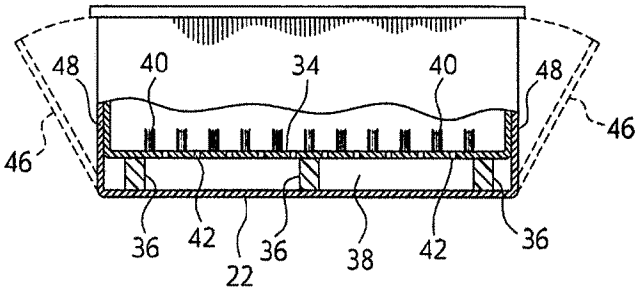
FIG. 2 is a partial cross-sectional view taken along line 2-2 in FIG. 4 wherein the cleaning platform of FIG. 5 is in position in the container structure body of FIG. 4.
Figure 7:
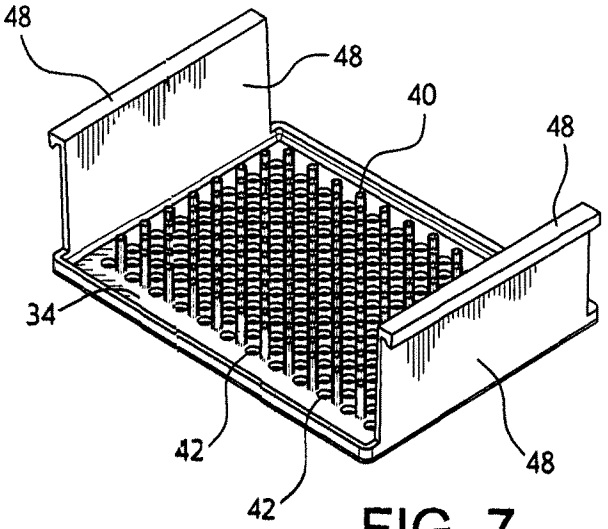
FIG. 7 is a perspective view of the tray in FIG. 5.
Figure 9:
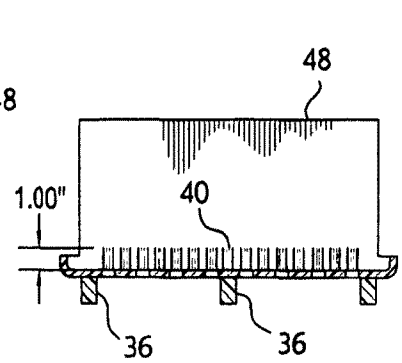
FIG. 9 is a cross-sectional view taken along line 9-9 in FIG. 5 with the ledge means (ports) affixed to the tray floor.
Figure 8:
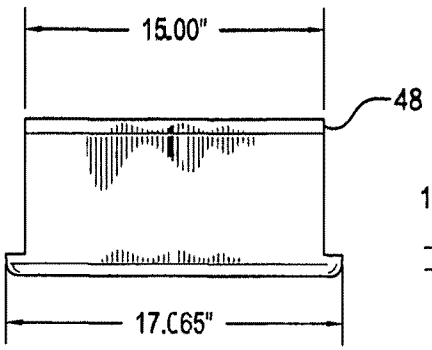
FIG. 8 is an end view of the body of FIG. 6.
Figure 5:
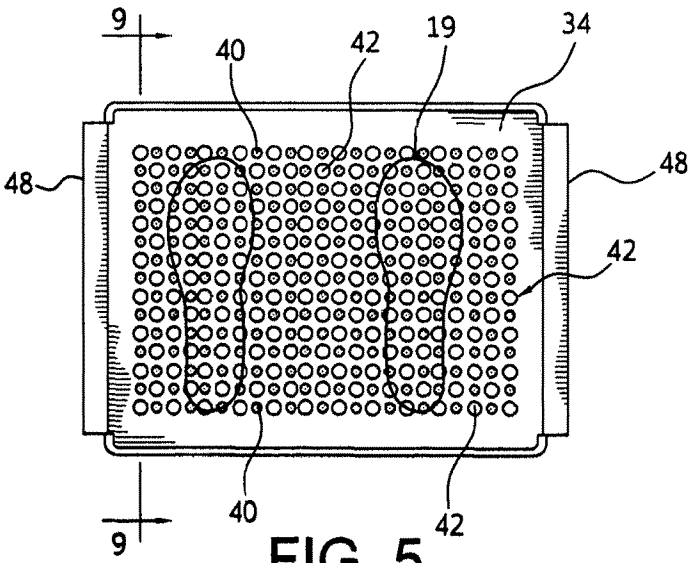
FIG. 5 is top view of one embodiment of the cleat scraping projections and the debris exit ports.
Figure 6:
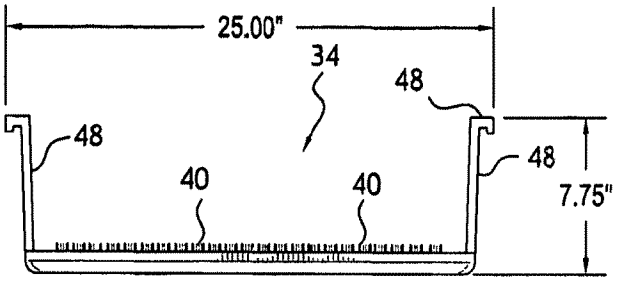
FIG. 6 is a side view of the tray of FIG. 5.
Figure 12:
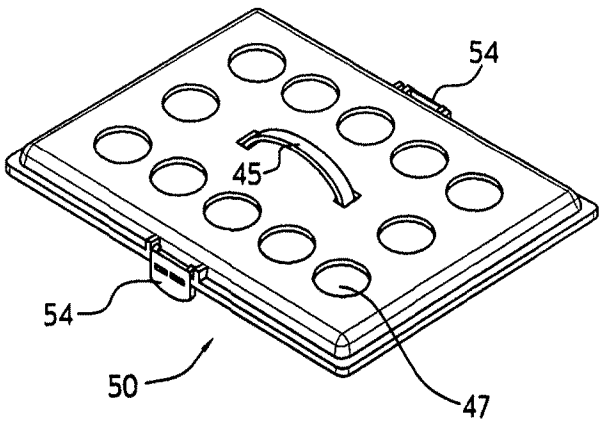
FIG. 12 is a perspective view of the lid of FIG. 10.
Figure 13:
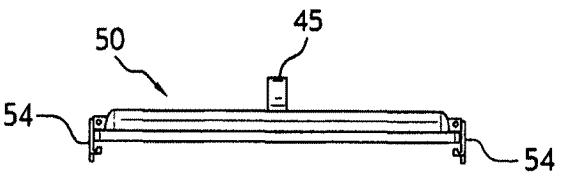
FIG. 13 is an end view of the lid of FIG. 10.
Figure 10:
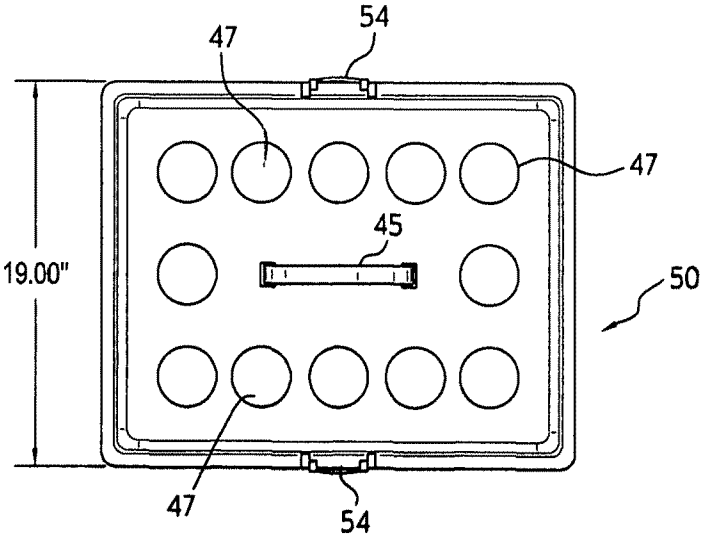
FIG. 10 is a top view of the container structure lid.
Figure 11:
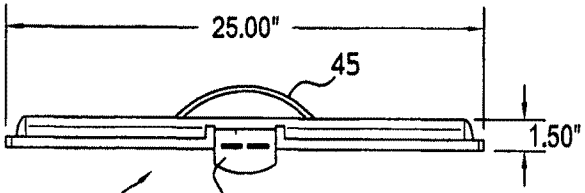
FIG. 11 is a partially sectioned side edge view of the lid of FIG. 10.

Referring to the drawings the present container structure is shown for a single pair of shoes but which can be expanded in size to accommodate multiple shoe pairs of any size. The container structure 20 comprises a body 21 having a floor 22 and peripheral upstanding side sections 24, 26 and end sections 28, 30 forming a vertically opening storage cavity 32. A substantially planar cleaning tray 34 is removably positioned within the cavity and rests substantially horizontally on ledge means 36 affixed to or molded on the container body whereby the platform is elevated above the floor to provide a debris collection receptacle space 38 between the floor 22 and the tray 34. The ledge means 36 preferably are of rubbery plastic or natural rubber post like members preferably of from about 0.5 to about 3 inches in height of a consistency which will not slide, e.g., on parking lot pavement or the like. In this regard, the tray 34 is dimensioned with respect to body 21 such that the tray can be easily slid out through the top of the body and placed on the pavement or ground so that the athlete can slide his or her feet on the tray and across the scraping projections 40 to dislodge at least some mud and grass such that the remaining mud and grass can more readily be accommodated by the container structure when the tray is placed back into it for transport. For this embodiment the tray preferably is formed of heavy duty, e.g., ½ in. thick aluminum or structural plastic such as poly butyrate or the like and wherein the number and placement of the ledge means 36 are such as to readily support a persons weight and their placement arrangement of FIG. 2 is typical for such purpose. The configuration of the ledge means preferably is selected from the group consisting essentially of post shaped (round, square oval, rectangular, or the like in cross section) and affixed to said floor and extending upwardly to said cleaning tray, or affixed to the underside of said tray and extending downwardly to said floor, or are shoulder means extending inwardly from said container body.

Figure 14:
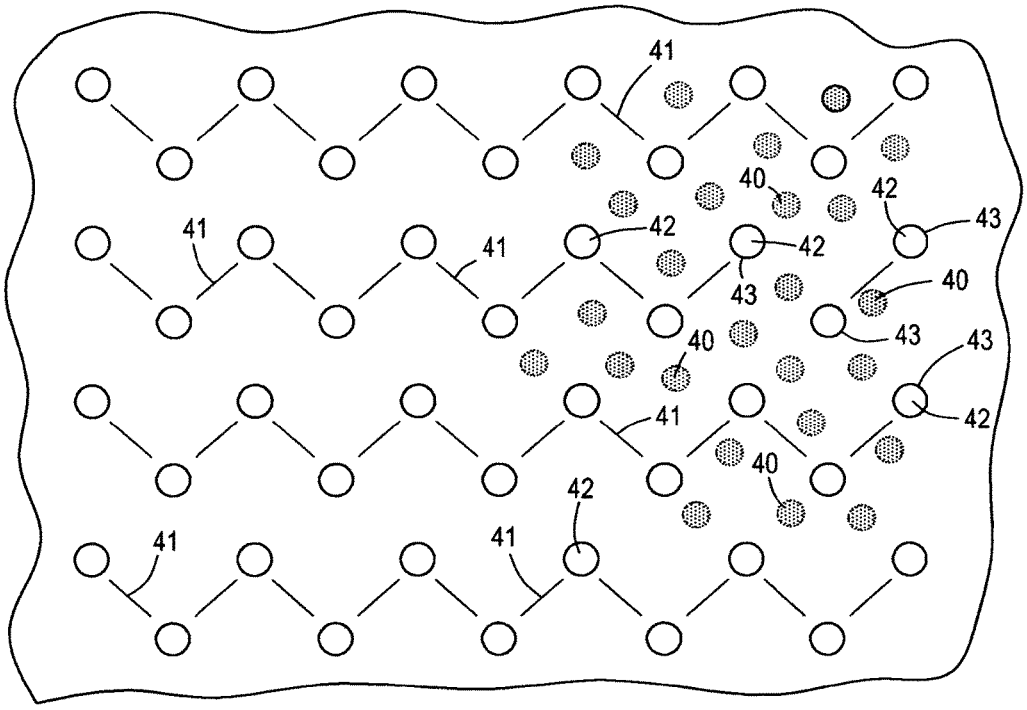
FIG. 14 is a bottom view of the scraping board showing the zig-zag pattern of the debris exit ports.

The tray 34 is provided with multiple upstanding brush means i.e., scraping projections 40 preferably which extend from about 0.5 to about 1.5 inches above the top surface of the tray and which are sufficiently rigid to scrape mud and grass from between the cleats of an athletic shoe. These projections generally surround and are spaced about 0.20 to about 1.0 inches from the perimeters 43 of debris exit ports 42 extending through the tray and opening into the debris receptacle basin 38. These ports 42 must be completely unblocked and of sufficient dimensioned capacity to allow mud and grass which loosely remain in small clumps between the cleats after the main scraping operation (e.g., outside of container 20) to readily fall through the ports by way, e.g., of simply jostling the cleats against the brush projections as the pre-scraped shoes are placed in the container for transport or storage. A preferred port is circular with a diameter of from about 0.5 in. to about 1.25 in. from each other and wherein the ports are arranged in lateral zig-zag shaped rows 41 (FIG. 14) to dislodge mud and grass from spaces between the cleats are sure to be contacted by the brushes and to ride over the open ports to release the debris through the ports either on the ground or into the collection basin of the container. In other embodiments the brush means 40 and the tray 34 can be altered in size and configuration as outdoor carpeting, Astro turf, rubber mat or the like as shown for example in U.S. Pat. No. 3,100,312 noted above.

Figure 4:
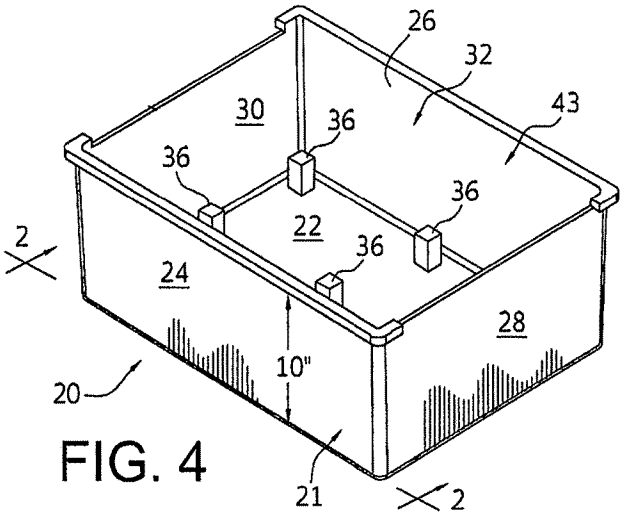
FIG. 4 is a perspective view of the container body.
Figure 3:
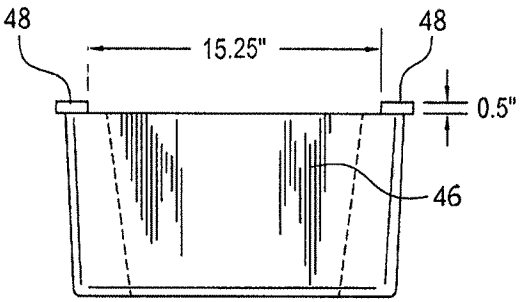
FIG. 3 is an end view of one embodiment of the container body structure.
Figure 1:
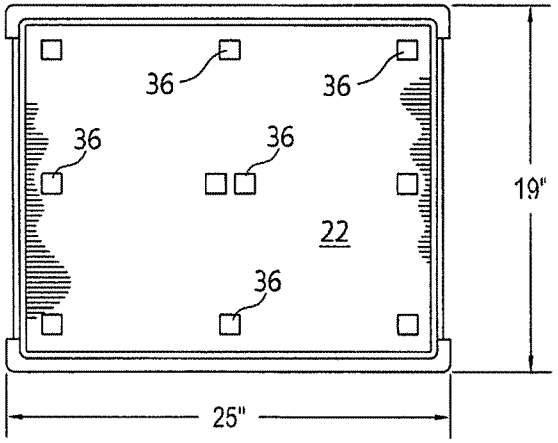
FIG. 1 is a view looking down into the empty body of the container structure embodiment of FIG. 4.

Referring to FIGS. 2 and 3, the dotted lines at the ends of the container body indicates pockets 46 which can be used if desired for the temporary transport, e.g., of other muddy gear. The cleaning tray optionally is provided with handles 48, however, as mentioned above the tray can be formed as a substantially flat member with or without handles and can be placed on the ground, usually a paved parking lot adjacent an athletic field, whereby the wearer can scrape his or her cleats over the projections before removing the cleat. The shaken off tray can then be placed back into the container body with the partially cleaned shoes resting thereon for transport.

Further preferred embodiments or the invention include the container having a removable lid 50 with lift handle 45 and lock down clasp means 54 covering the top opening 43 of the container wherein the lid is provided with multiple ventilation holes 47;

the container is made of easy to clean plastic or other smooth surfaced material of any chosen color;

the container tray is provided with handle means 48 for lifting the platform out of the cavity whereby the tray, the cavity and the receptacle can be easily cleaned; and the container body and tray and the scraping projections comprise (bristles) are formed of polyolefin, acrylic, polyvinyl, polyurethane, Teflon, polyamide, polycarbonate Nylon or the like material.

The invention has been described in detail with particular reference to preferred embodiments thereof, but it will be understood that variations and modifications will be effected within the spirit and scope of the invention.

I claim:

1. A cleated athletic shoe cleaning device for cleaning debris from between the cleats of said shoe, said device comprising a box shaped container having opposing sides and ends, a floor, and a top opening, a substantially planar cleat scraping tray having a top side and a bottom side and being dimensioned to be removable through said top opening, wherein said tray is provided with a plurality of substantially circular debris exit apertures extending through said sides, said apertures having a diameter of from about ⅜ in. to about 1.25 in., a plurality of cleat scraping projections affixed to said top side and extending substantially vertically upwardly therefrom, said projections being spaced from each other in a generally circular pattern surrounding each, aperture and being radially spaced therefrom about ⅛ in. to about ¾ in. so as not to interfere with the passage of debris therethrough, foot means on said bottom side and extending downwardly therefrom to rest on said floor and to provide a debris collection area between said tray and said floor.

2. The device of claim 1 wherein said apertures are arranged in columns across said tray, each column having a zig-zag pattern of said apertures.

3. The device of claim 2 wherein said projections are each comprised of a bundle of semi-rigid fibers.

4. The device of claim 3 wherein said foot means are from about ½ in. to about 2.0 in. in length.

5. The device of claim 4 wherein said projections are from about ½ in. to about 2.0 in. in length.

6. The device of claim 1 wherein said container has a removable lock down lid covering said top opening wherein said lid is provided with multiple ventilation holes.

7. The device of claim 1 wherein said tray is provided with handle means for lifting said tray out of said cavity whereby said tray and said collection area can be easily cleaned of debris scraped from said cleats.

8. The device of claim 1 wherein said scraping projections comprise a bundle of brush type bristles of material selected from polyolefin, acrylic, polyurethane, Teflon, polybutyrate, polyamide, Nylon or natural cellulosic material.

9. The device of claim 1 wherein said foot means comprises post shaped structures affixed to interior surface portions of said floor.

10. The device of claim 1 wherein said foot means comprises post shaped structures affixed to underside portions of said tray.

* * * * *